US006415542B1

(12) United States Patent
Bates et al.

(10) Patent No.: US 6,415,542 B1
(45) Date of Patent: Jul. 9, 2002

(54) LOCATION-BASED FIREARM DISCHARGE PREVENTION

(75) Inventors: Cary Lee Bates; Eric John Nelson; John Matthew Santosuosso, all of Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/552,140

(22) Filed: Apr. 19, 2000

(51) Int. Cl.[7] ..... F41A 17/00
(52) U.S. Cl. ..... 42/70.11; 42/70.05; 42/70.06
(58) Field of Search ..... 42/70.11, 70.01, 42/70.02, 70.03, 70.04; 89/137, 142, 148, 154; 124/32, 34

(56) References Cited

U.S. PATENT DOCUMENTS

| | | | | | |
|---|---|---|---|---|---|
| 3,785,261 | A | | 1/1974 | Ganteaume | 95/12 |
| 4,067,411 | A | | 1/1978 | Conley et al. | 180/114 |
| 4,541,191 | A | | 9/1985 | Morris et al. | 42/1 A |
| 4,682,435 | A | * | 7/1987 | Heltzel | 42/70.01 |
| 5,168,114 | A | | 12/1992 | Enget | 42/70.01 |
| 5,192,818 | A | | 3/1993 | Martin | 42/70.01 |
| 5,303,495 | A | | 4/1994 | Harthcock | 42/84 |
| 5,423,143 | A | | 6/1995 | Martin | 42/70.01 |
| 5,459,957 | A | * | 10/1995 | Winer | 42/70.11 |
| 5,461,812 | A | * | 10/1995 | Bennett | 42/70.11 |
| 5,479,149 | A | | 12/1995 | Pike | 340/539 |
| 5,537,771 | A | | 7/1996 | Martin | 42/70.01 |
| 5,566,486 | A | | 10/1996 | Brinkley | 42/1.02 |
| 5,675,925 | A | * | 10/1997 | Wurger | 42/70.06 |
| 6,223,461 | B1 | * | 5/2001 | Mardirossian | 42/70.11 |

* cited by examiner

*Primary Examiner*—Charles T. Jordan
*Assistant Examiner*—Stephen A Holzen
(74) *Attorney, Agent, or Firm*—Wood Herron & Evans LLP

(57) ABSTRACT

A firearm, program product and method collectively utilize an on-board location sensor (e.g., a GPS receiver) and stored location information to selectively inhibit discharge of a firearm based on the current location of the firearm. Location information identifying one or more prohibited locations is stored in the firearm (typically in an on-board memory). A controller on-board the firearm then accesses the location sensor to determine a current location for the firearm, and selectively inhibits the discharge of the firearm if the current location is proximate any prohibited location.

28 Claims, 3 Drawing Sheets

LOCATION-BASED FIREARM DISCHARGE PREVENTION

FIELD OF THE INVENTION

The invention is generally related to firearm safety, and in particular, to the prevention of unauthorized and/or unintended discharge of a firearm.

BACKGROUND OF THE INVENTION

Firearms such as handguns, hunting rifles, shotguns and other weapons have a number of lawful uses, including self-defense, hunting, law enforcement and military uses. However, due to the extremely dangerous nature of firearms, a significant concern also exists as to other, improper uses of firearms. Criminals may use firearms in the commission of crimes, either discharging the firearms to injure or kill, or in the least, using firearms to threaten others. A concern also exists as to accidental discharges of a firearm, as well as to dangers to children that find unattended firearms in the home. Many schools also have a problem with students occasionally bringing guns to school, posing a risk to themselves, other students and school employees.

Significant efforts have been devoted to minimizing the risks associated with improper usage of a firearm. A number of gun manufacturers, for example, provide mechanical trigger locks that prevent actuation of a firearm when installed. Often, however, trigger locks are cumbersome to operate, and may be difficult to remove, which many firearm owners perceive as diminishing the value of the firearm for the purpose of self-defense. As a result, many owners opt against installing trigger locks on their firearms, thus defeating the utility of manufacturer-provided locks.

Various "smart gun" technologies have also been developed and proposed to automatically control the discharge of a firearm. Biometric controls such as fingerprint sensors have been proposed to restrict discharge of a firearm only to an authorized person having a fingerprint pattern stored in the firearm. Personal area transmitters have also been proposed, e.g., disposed on a ring or other piece of jewelry worn by a gun owner that would permit actuation of a firearm only when the firearm is capable of receiving a short-range signal from the transmitter.

While conventional "smart gun" technologies address a number of the concerns associated with improper firearm usage, additional concerns still remain. For example, an authorized owner or operator of a firearm is still capable of using the firearm for unlawful purposes. As such, an authorized owner of a firearm could use a firearm in a bank or government building if he or she so desired. In addition, firearms that are required to be within receiving distance of a transmitter could still be actuated if an unauthorized person was also able to obtain the transmitter from the authorized owner.

It has also been proposed to provide anti-firing systems within firearms that disable the firearms whenever the firearms are within a certain distance of a transmitter. By placing a transmitter in a bank, government building, or other area for which is desirable to prevent discharge of a firearm, any firearm having a receiver capable of receiving the transmitted signal would be automatically disabled. Providing a workable system that incorporates such technology, however, would be extremely expensive and require a large number of transmitters to be installed at a multitude of locations, as well as existing firearms abandoned in favor of new designs incorporating the required receivers.

Therefore, a significant need continues to exist in the art for an improved firearm discharge prevention system that restricts improper usage of a firearm, in particular, in a manner that is simpler, less expensive, and more flexible than conventional technologies.

SUMMARY OF THE INVENTION

The invention addresses these and other problems associated with the prior art by providing a firearm, program product and method in which an on-board location sensor and stored location information are collectively utilized to selectively inhibit discharge of a firearm based upon its current location. Location information identifying one or more prohibited locations is stored in the firearm (typically in an on-board memory). A controller on-board the firearm then accesses the location sensor to determine a current location for the firearm, and selectively inhibits the discharge of the firearm if the current location is proximate any prohibited location.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described exemplary embodiments of the invention.

DETAILED DESCRIPTION

Figure 1:
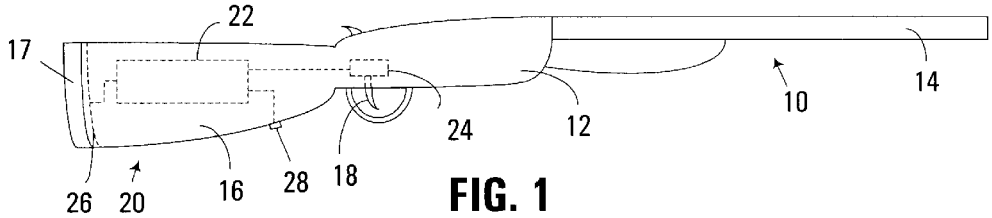
FIG. 1 is a schematic diagram of a long gun firearm incorporating a location-based discharge prevention system consistent with the invention.

FIG. 1 illustrates an exemplary firearm 10 incorporating a location-based discharge prevention mechanism consistent with the invention. Firearm 10 is illustrated as a long gun such as a rifle or shotgun, including a receiver or main body 12 coupled to a barrel 14 and a stock or handle 16. A butt end of stock 16 is covered by a recoil pad 17 also functioning as a cap or access panel on the end of the stock. Firearm 10 is actuated through manual depression of a trigger 18, as is well known in the art.

A discharge prevention system 20 is illustrated in firearm 10, including a main controller 22 coupled to an electrically-actuated trigger lock 24 for selectively inhibiting or permitting actuation of the firearm by depression of trigger 18. A user interface or control panel 26 is also interfaced with controller 22, as is an on/off button 28 disposed a convenient and accessible location on the stock of the firearm.

Figure 2:
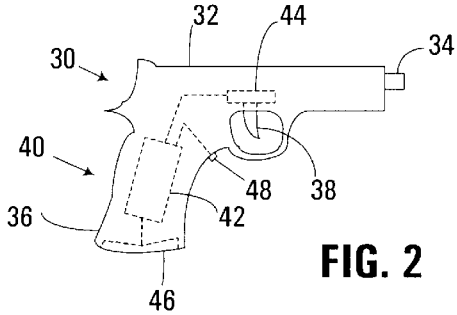
FIG. 2 is a schematic diagram of a hand gun firearm incorporating a location-based discharge prevention system consistent with the invention.

A discharge prevention system may be incorporated into other types of firearms consistent with the invention. For example, FIG. 2 illustrates an alternate firearm 30 implemented as a handgun, including a receiver 32, barrel 34, handle 36 and trigger 38. A discharge prevention system 40 is illustrated including a controller 42, electrically-actuated trigger lock 44, user interface 46 and on/off button 48. It will be appreciated that a discharge prevention system consistent with the invention may also be utilized in a wide variety of alternate firearm designs. The invention is therefore not limited to the particular implementations disclosed herein.

Returning to FIG. 1, it is typically desirable in the illustrated implementation to minimize tampering by restricting access to the primary components in discharge prevention system 20. As such, it is typically desirable to mount controller 22 within a recess in handle 16 of firearm 10. Trigger lock 24 likewise is mounted in an appropriate difficult-to-access location to control the actuation of trigger 18. For normal operation of the firearm, it is desirable to provide an easily-accessible mechanism for actuating controller 22, provided here by an on/off button 28 disposed on the handle of firearm 10. Button 28 may be implemented, for example, as a momentary switch, a slide switch, a push-button switch, a touch sensor, or any other known switch design. In addition, in some implementations it may be desirable to omit switch 28, and thereby provide constant-on capability.

Programming and other supervisory operations with controller 22 are provided through control panel 26, which in the illustrated implementation is covered by the recoil pad 17. Among other advantages, it is believed that supervisory activities will be required only on an intermittent basis, and as such, restricting access to the control panel is not a significant burden for an owner. Moreover, restricting access improves the aesthetic look of the firearm, and may conceal the fact that the discharge prevention system is installed on the firearm. In other embodiments, however, the control panel may be disposed on other locations on a firearm, and may or may not be covered by a recoil pad or any other type of access panel. Moreover, various alternate placements of the various components in system 20 may be utilized in the alternative.

Figure 3:
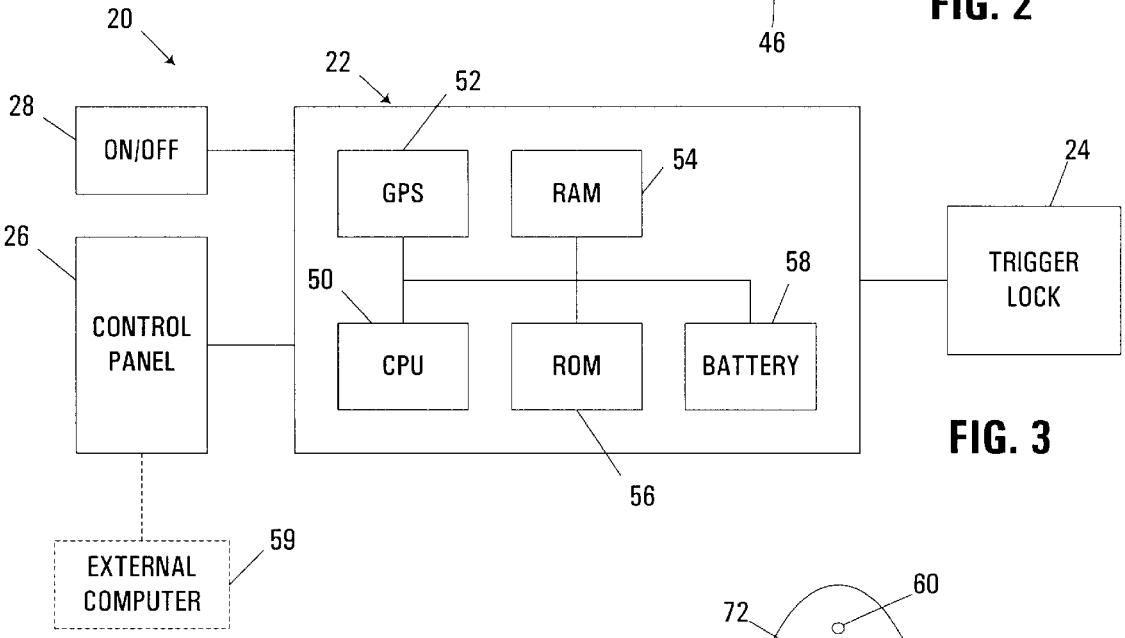
FIG. 3 is a block diagram of the location-based discharge prevention system of FIG. 1.

FIG. 3 next illustrates the primary electronic components in discharge prevention mechanism 20. In particular, controller 22 is illustrated as interfacing with trigger lock 24, control panel 26, and on/off switch 28, and including a central processing unit (CPU) 50 coupled to a global positioning system (GPS) location sensor or receiver 52, a random access memory (RAM) 54, a read-only memory (ROM) 56 and a battery 58.

CPU 50 may include any type of microcontroller or microprocessor suitable for implementing the functionality described herein.

Location sensor 52 includes the control electronics and other circuitry used to receive GPS signals and determine a current location of the GPS receiver via GPS satellite information. Sensor 52 may also include suitable antenna circuitry for improving reception of the satellite signals. It will also be appreciated that other types of location sensors capable of determining a current location of a firearm, may be used in the alternative.

A primary function of CPU 50 is to execute a program that selectively inhibits discharge of the firearm based upon whether the current location of the firearm, as determined using location sensor 52, is within any of a number of excluded regions defined by location information stored in one or both of RAM 54 and ROM 56. Typically, ROM 56 also stores the program executed by CPU 50 to perform the herein described functionality.

In the illustrated embodiment, both RAM 54 and ROM 56 store location information that identifies one or more excluded regions where the firearm is not permitted to be discharged. ROM 56 typically stores hard-coded location information that cannot be modified by a user. Doing so permits a manufacturer or government agency, for example, to establish regions that a firearm cannot be used, e.g., around schools, within city limits, within government buildings, etc. RAM 54, on the other hand, stores programmed location information that a user inputs to customize the firearm for that user's particular situation. For example, a user may wish to program a firearm to not be capable of being fired within the user's home, e.g, as with a hunting rifle where the primary purpose of the firearm is for hunting, and not for self-defense.

In other implementations, only pre-programmed information or customizable location information may be stored in a firearm consistent with the invention. Moreover, other types of memory devices may be utilized to store location information consistent with the invention. For example, hard-wired logic and other read-only memory technologies may be used to provide permanent (pre-programmed) location information. Random access memory technologies such as volatile and non-volatile solid state memories, flash memories, removable cards, mass storage devices, such as hard disk drives, or any other recordable electronic storage medium may be used to retain customized location information consistent with the invention.

Different manners of identifying excluded regions via location information may also be used consistent with the invention. For example, an excluded region may be defined by a point in space (e.g., via latitude and longitude coordinates) in combination with an optional distance parameter, such that a region is defined within a defined perimeter from a single point in space. In the alternative, a region may be defined via its boundaries to, in effect, define a more complex perimeter for the region. A region may also be defined by defining distance parameters in latitudinal or longitudinal distances, i.e., to define a region as being +/−X meters longitudinally and +/−Y meters latitudinally from a specific point. A distance parameter may be consistent regardless of direction to provide an essentially circular region, or different distance parameters may be provided in different directions to provide non-circular excluded regions. Regions may also be defined with varying boundaries in association with a firearm direction, e.g., as determined using an electronic compass. Such functionality would permit, for example, a firearm to be discharged at particular location only when pointed in a particular direction or range of directions.

Furthermore, rather than storing location information that defines excluded regions, location information may explicitly define permitted regions, such that the absence of a matching region for a current location of a firearm results in discharge of the firearm being prevented. As such, location information may, in effect, identify prohibited locations via negative implication.

Battery 58 is utilized to power the various electronic components in system 20. Any number of known battery technologies and other power sources may be used in the alternative.

Trigger lock 24 may be implemented using any known electrically-actuated discharge inhibitor, e.g., as illustrated in U.S. Pat. No. 5,168,114, among others. If a trigger is utilized to mechanically actuate a firearm, some form of mechanical linkage to the trigger or other components in the firing mechanism of a firearm is necessary in trigger lock 24 to inhibit the mechanical actuation of the firearm. In other implementations, however, a firearm may be discharged solely in response to an electrical signal (e.g., with a solenoid-actuated firing mechanism), whereby trigger lock 24 may simply incorporate electronic circuitry for inhibiting generation of an appropriate actuation signal to actuate the firearm.

In the illustrated implementation, trigger lock 24 is a normally-locked mechanism that inhibits actuation of the firearm in the absence of a control signal provided by controller 22. As such, should controller 22 be disabled, e.g., due to tampering, low battery, etc., discharge of the firearm is not permitted. In other implementations, however, a normally-unlocked trigger lock may be used.

Programming of customizable location information into system 20 may be performed in a number of manners. As will be discussed in greater detail below, a prohibited location (excluded region) may be defined, for example, by selecting a point in space based upon the current location of the firearm when a programming operation occurs, thus necessitating that the firearm is currently located in a region where it is desirable to disable the firearm. More detailed location information may be directly input by a user in the alternative, such that the user is not required to locate the firearm in a particular region. Input of location information may be provided via the control panel 26 or another on-board user interface on the firearm. In the alternative, programming of the firearm may be implemented through an electronic interface to an external computer 59, providing the various user interface options (e.g., graphical user interfaces) available with personal computers and the like. Such an implementation could permit, for example, a user to view a topological representation of a geographic area and graphically select region boundaries via a graphical user interface.

Among other possible sources of location information, programming the firearm via an external computer could also permit a user, for example, to download location information from a network such as the Internet, e.g., by logging onto a website of the firearm manufacturer. Any number of alternate sources of location information may also be used in the alternative.

Figure 4:
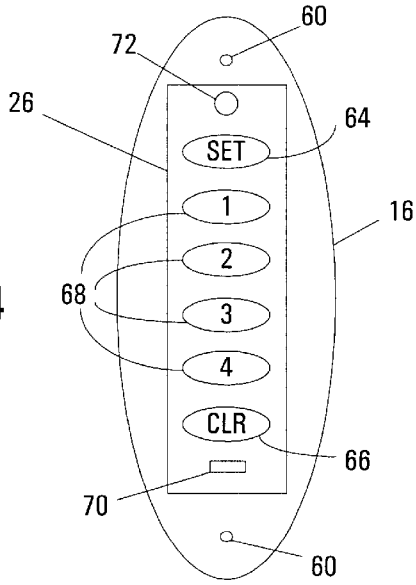
FIG. 4 is a end elevational view of the firearm of FIG. 1 with a recoil pad therefor removed, and illustrating an exemplary implementation of the control panel of FIG. 3.

One suitable implementation of control panel 26 is illustrated in greater detail in FIG. 4. As shown in this figure, the butt end of handle 16 of firearm 10 is illustrated with the recoil pad removed. Threaded apertures 60 for receiving fasteners that secure the recoil pad to the handle are illustrated in the figure. Control panel 26 is illustrated including a set button 64, a clear button 66, and four numerical buttons 68 through which a user inputs a password. User feedback is provided by a visual indicator 70, e.g., an LED. In addition, an electronic interface 72 is provided on control panel 26 for interfacing with an external computer. Interface 72 may be implemented using any number of known interface technologies, including, for example, USB ports, IEEE 1394 ports, serial ports, etc. Moreover, various wireless technologies including Bluetooth and wireless Ethernet may also be used in the alternative, whereby physical interconnection of the firearm with an external computer would not be required. It will be appreciated that in other implementations, no external electronic interface may be provided on a firearm.

Figure 5:
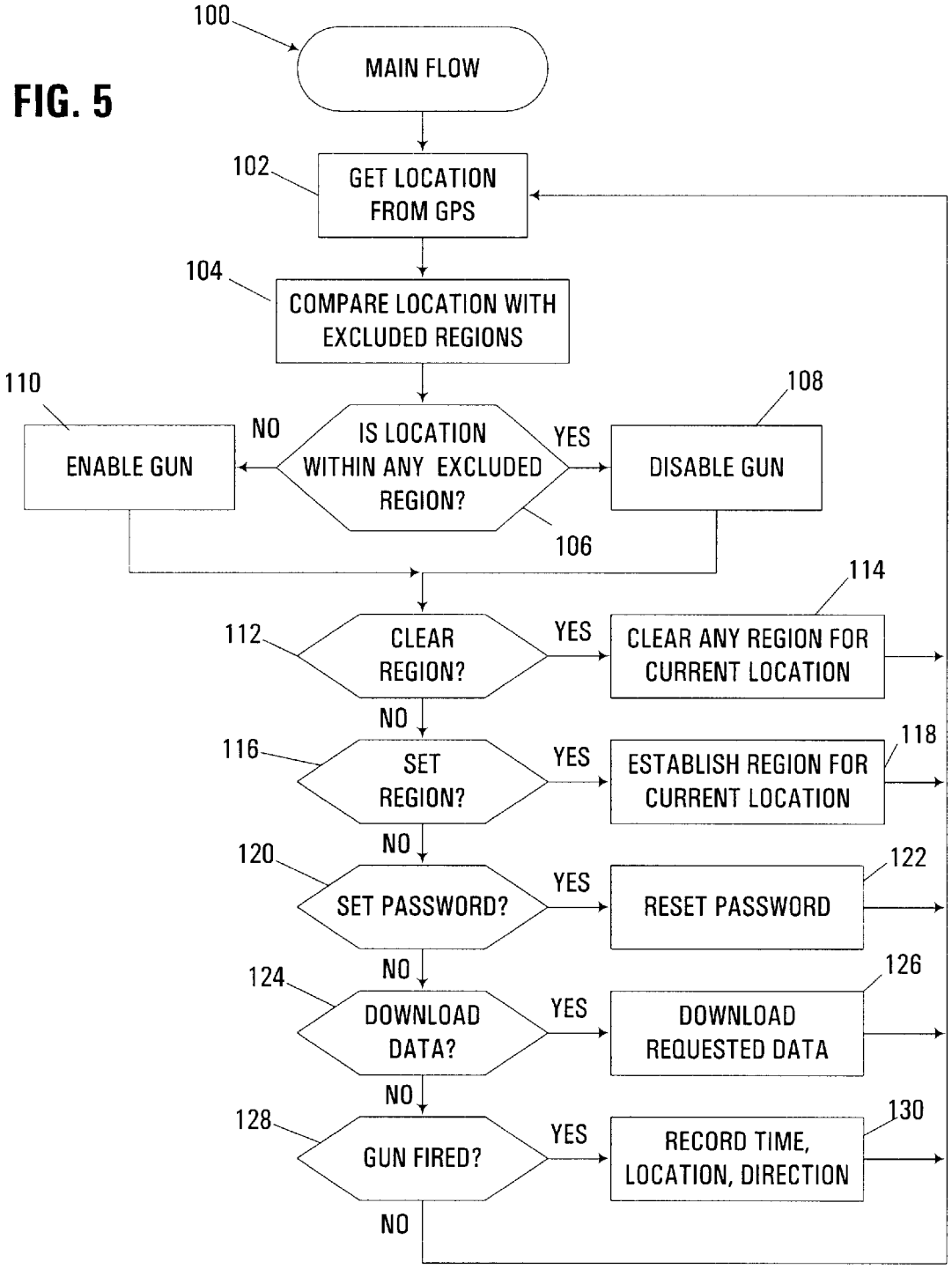
FIG. 5 is a flowchart illustrating the primary program flow of the central processing unit of FIG. 3.

FIG. 5 next illustrates a main flow routine 100 representing the primary sequence of operations performed by central processing unit 50 for implementing the functionality described herein. Central processing unit 50 typically operates under the control of an embedded operating system, and executes or otherwise relies upon various software and/or firmware applications, components, programs, objects, modules, data structures, etc. In general, the routines executed to implement the embodiments of the invention, whether implemented as part of an operating system or a specific application, component, program, object, module or sequence of instructions, will be referred to herein as "computer programs", or simply "programs". The computer programs typically comprise one or more instructions that are resident at various times in various memory and storage devices in a computer or other programmable electronic device, and that, when read and executed by one or more processors in such a device, cause that device to perform the steps necessary to execute steps or elements embodying the various aspects of the invention. Moreover, while the invention has and hereinafter will be described in the context of fully functioning computers and other programmable electronic devices, those skilled in the art will appreciate that the various embodiments of the invention are capable of being distributed as a program product in a variety of forms, and that the invention applies equally regardless of the particular type of signal bearing media used to actually carry out the distribution. Examples of signal bearing media include but are not limited to recordable type media such as volatile and non-volatile memory devices, floppy and other removable disks, hard disk drives, magnetic tape, optical disks (e.g., CD-ROM's, DVD's, etc.), among others, and transmission type media such as digital and analog communication links.

Routine 100 begins in block 102 by obtaining a current location from the GPS sensor. Next, block 104 compares the current location with the location information stored in the RAM and/or ROM to identify whether the current location is proximate any excluded region. As discussed above, in the alternative, the current location may be compared with permitted regions, with the absence of a match being used to indicate that the firearm is in an excluded region. In the illustrated implementation, determining whether the current location is within, or proximate, a prohibited location may be performed by determining a distance between the current location and the prohibited location, and determining whether the distance is below a certain threshold. In the alternative, e.g., if a boundary is defined for a prohibited location, the determination may be made by determining whether the current location falls within the boundary.

Next, block 106 determines whether the current location is defined within any excluded region. If so, the firearm is disabled in block 108. If not, however, the firearm is enabled in block 110. Using the aforementioned normally-locked trigger lock design, block 110 typically results in assertion of a control signal to activate the trigger lock and thereby permit actuation of the firearm. Disabling of the gun, on the other hand, requires no positive action on the part of the controller by virtue of the normally-locked configuration of the trigger lock. Therefore, block 108 may not perform any positive operations in some implementations.

Upon completion of either block 108 or 110, it is determined whether any number of events are received based upon activities that occur with the firearm.

Block 112, for example, detects a clear region event, which is initiated, for example, in response to a clear region command received from a user via the control panel or an external computer. In response to such an event, control passes to block 114 to clear any excluded region from the location information stored in the firearm that matches the current location of the firearm. As discussed above, in the illustrated implementation, the current location of the firearm is used to both set and clear excluded regions from the firearm. In the alternative, however, the current location of the firearm may not be relevant to clear and set commands, whereby such commands would need to provide additional data to identify what regions to add or remove from the firearm memory. However, implementation of such alternative implementations would be within the ability of one of ordinary skill in the art having the benefit of the instant disclosure.

Block 116 detects a complementary set region command, which is generated, for example, in response to user input received via the control panel or the external computer. In response to the event, control passes to block 118 to an establish an excluded region for the current location of the firearm. In the illustrated implementation, this is performed by storing in the RAM a point in space corresponding to the current location as sensed by the GPS sensor, as well as an optional distance factor determining the size of the region circumscribing the point in space. In the alternative, regions can have a fixed radius.

Another event that may be detected is a set password event, which is detected in block 120 and handled in block 122 by resetting the password to that provided by the event. The password may be set, for example, through the control panel or an external computer, often after entering the original password to confirm authorization.

Block 124 detects a download data event, which is typically received from an external computer via the electronic interface, and is handled by passing control to block 126 to download requested data. It may be desirable, for example to download the current location information stored in the firearm. It may also be desirable to download discharge history data for the firearm that indicates when and where the firearm was discharged. Other relevant information may also be downloaded consistent with the invention.

Block 128 detects a gun fired event, which occurs in response to actuation of the firearm. In response to such an event, control passes to block 130 to record the time and location of the firearm at the time of actuation of the firearm. This latter feature, which is optional, may be useful for law enforcement agencies to determine where a firearm was at the time it was discharged. In addition, given that many GPS sensors often incorporate electronic compass technology, it may also be possible to record the direction that the firearm was pointing at the time of the discharge. Other controls, e.g., electronic gyroscopes, etc., may be used as well to provide additional telemetric information for the firearm as it is discharged. In the alternative, such recording may be omitted in some implementations.

It will be appreciated that routine 100 is typically initiated in response to depression of the on/off button to activate the weapon. In the alternative, the firearm may be on persistently. In addition, it will be appreciated that routine 100 may also be terminated via depression of the on/off button, or after timing out after receiving no input for a predetermined amount of time. Telemetric data may also be used to automatically timeout the firearm if the weapon has not been moved for a predetermined amount of time.

As discussed above, a wide variety of user interface actions may be utilized to interface with the discharge prevention system consistent with the invention. For example, FIGS. 6–8 respectively illustrate various user interface actions that may be performed to set a password, set an excluded region and clear an excluded region for the firearm. Particularly when an external computer is utilized to interface with the firearm, it will be appreciated that a wide variety of graphical, textual, and other user interface actions may be used in the alternative.

Figure 6:
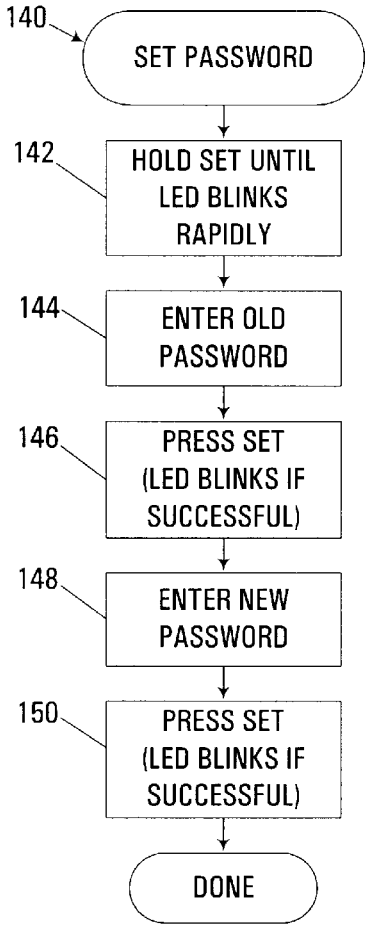
FIG. 6 is a flowchart illustrating an exemplary sequence of operations initiated by a user in setting a password for the firearm of FIG. 1.

FIG. 6 illustrates a set password routine 140 that represents a sequence of operations that a user may utilize in interacting with the control panel to set a password for the firearm. As shown in block 142, the user may be required to hold the set button on the control panel until the LED blinks rapidly, indicating that the set password mode has been activated. In block 144, a user then enters an old password, which may any combination of the four numerical buttons on the control panel. Any other number of keypad and other input combinations may be utilized to generate a password consistent with the invention. Also, biometric controls may also be used with suitable components installed on the firearm.

If the old password is entered correctly, a user then presses the set button in block 146, with the LED blinking if the operation was successful. Next, in block 148, the user enters the new password, and in block 150, again presses the set button to store the new password in the firearm. It is anticipated that the LED may also be blinked if the operation is successful.

Figure 7:
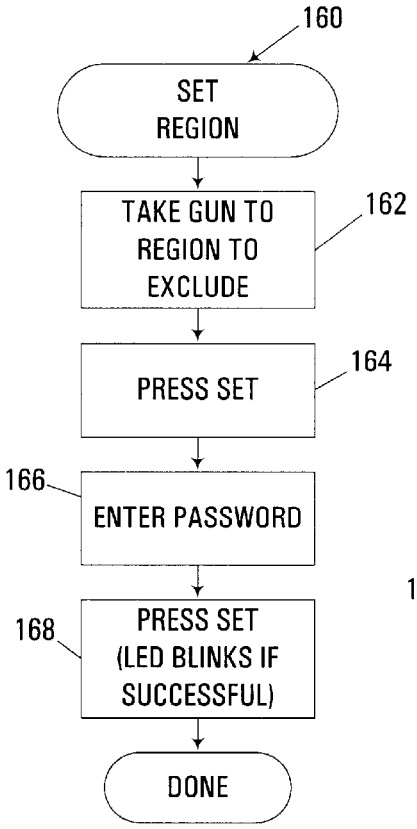
FIG. 7 is a flowchart illustrating an exemplary sequence of operations initiated by a user in setting an excluded region for the firearm of FIG. 1.

FIG. 7 illustrates the sequence of operations that may be utilized to perform a set region operation 160 using the control panel. First, a user takes the firearm to a prohibited location in block 162. The user then presses the set button in block 164, and enters the password in block 166. The user then presses the set button in block 168, and if the correct password has been entered, the LED blinks and the current location is stored in the memory for the firearm to add another excluded region.

Figure 8:
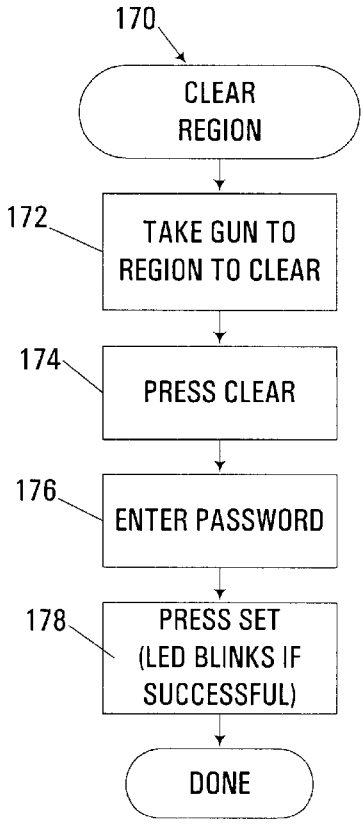
FIG. 8 is a flowchart illustrating an exemplary sequence of operations initiated by a user in clearing an excluded region for the firearm of FIG. 1.

FIG. 8 next illustrates the sequence of operations that may occur in response to a clear region operation 170. To clear an existing region from the firearm, the user takes the gun to a region to clear in block 172, then presses the clear button in block 174. The user then enters a password in block 176, and presses the set button in block 178. If a valid password is entered, the LED blinks, and any region matching the current location of the firearm is removed from the memory, thereby removing the excluded region from the firearm.

It will be appreciated that implementation of the above-described functionality would be well within the ability of one of ordinary skill in the art having the benefit of the instant disclosure. Moreover, a wide variety of alternate steps may be utilized to perform the above-described functionality consistent with the invention.

Various modifications may be made to the illustrated embodiments without departing from the spirit and scope of the invention. For example, an indicator may be provided externally on the firearm to indicate whether or not the firearm is actively being prevented from discharge. In addition, enabling of the trigger lock may be performed actively as long as a firearm is not within an excluded region, or in the alternative, may be activated only in response to user input, e.g., partial depression of a trigger.

Other modifications will be apparent to one of ordinary skill in the art. Therefore, the invention lies in the claims hereinafter appended.

What is claimed is:

1. A firearm, comprising:

(a) a memory configured to store location information identifying at least one prohibited location proximate which discharge of the firearm is to be inhibited;

(b) a location sensor configured to determine a current location of the firearm; and (c) a controller coupled to the memory and the location sensor, the controller configured to inhibit discharge of the firearm if the current location of the firearm determined by the location sensor is proximate a prohibited location stored in the memory.

2. The firearm of claim 1, wherein the memory comprises at least one of a read only memory (ROM) and a random access memory (RAM).

3. The firearm of claim 1, wherein the location sensor comprises a global positioning system (GPS) receiver.

4. The firearm of claim 1, wherein the controller is further configured to add and remove prohibited locations to and from the memory in response to user input.

5. The firearm of claim 4, wherein the controller is further configured to receive a user password prior to adding or removing a prohibited location to or from the memory.

6. The firearm of claim 5, wherein the controller is further configured to modify the user password in response to user input.

7. The firearm of claim 4, wherein the firearm further comprises a user interface disposed on the firearm and configured to receive user input from a user to add and remove prohibited locations to and from the memory.

8. The firearm of claim 4, wherein the firearm further comprises an electronic interface configured to interface with an external computer for programming the firearm via the external computer.

9. The firearm of claim 8, wherein the controller is further configured to record at least one of a time, location and direction of the firearm in response to discharge of the firearm, and to transmit the same to the external computer via the electronic interface.

10. The firearm of claim 1, further comprising a manually actuated trigger and an electrically-actuated, normally-locked trigger lock coupled to the trigger, wherein the controller is configured to inhibit discharge of the firearm by asserting a control signal to unlock the trigger lock only if the current location of the firearm determined by the location sensor is not proximate a prohibited location stored in the memory.

11. The firearm of claim 1, wherein the location information for the prohibited location identifies a point in space, and wherein the controller is configured to determine whether the current location of the firearm is proximate the prohibited location by determining a distance between the current location and the point in space.

12. The firearm of claim 1, wherein the location information for the prohibited location identifies a boundary of a region in space, and wherein the controller is configured to determine whether the current location of the firearm is proximate the prohibited location by determining whether the current location is within the boundary.

13. The firearm of claim 1, further comprising a handle configured to house the memory, the controller and the location sensor.

14. The firearm of claim 13, further comprising:

(a) a user interface disposed on the handle and electrically coupled to the controller to receive user input; and (b) a removable access panel secured to the handle overlaying the user interface.

15. The firearm of claim 1, wherein the firearm comprises a long gun.

16. The firearm of claim 1, wherein the firearm comprises a handgun.

17. A method of inhibiting discharge of a firearm, the method comprising:

(a) determining a current location of the firearm using a location sensor coupled to the firearm; and (b) inhibiting discharge of the firearm if the current location of the firearm is proximate a prohibited location identified in a memory coupled to the firearm.

18. The method of claim 17, wherein determining the current location includes accessing a global positioning system (GPS) receiver.

19. The method of claim 17, further comprising:

(a) adding location information for an additional prohibited location to the memory in response to user input; and (b) removing location information for a prohibited location from the memory in response to user input.

20. The method of claim 19, further comprising receiving a user password prior to adding or removing location information to or from the memory.

21. The method of claim 20, further comprising modifying the user password in response to user input.

22. The method of claim 17, further comprising programming the firearm using an external computer coupled to the firearm via an electronic interface.

23. The method of claim 22, further comprising:

(a) recording at least one of a time, location and direction of the firearm in response to discharge of the firearm; and (b) transmitting the same to the external computer via the electronic interface.

24. The method of claim 17, wherein the firearm includes a manually actuated trigger and an electrically-actuated, normally-locked trigger lock coupled to the trigger, wherein inhibiting discharge of the firearm includes asserting a control signal to unlock the trigger lock only if the current location of the firearm is not proximate a prohibited location identified in the memory.

25. The method of claim 17, wherein the memory includes location information for the prohibited location that identifies a point in space, the method further comprising determining whether the current location of the firearm is proximate the prohibited location by determining a distance between the current location and the point in space.

26. The method of claim 17, wherein the memory includes location information for the prohibited location that identifies a boundary of a region in space, the method further comprising determining whether the current location of the firearm is proximate the prohibited location by determining whether the current location is within the boundary.

27. A program product, comprising:

(a) a program configured to be executed by a controller disposed within a firearm, the program configured to determine a current location of the firearm by accessing a location sensor coupled to the firearm, to access a memory coupled to the firearm to obtain location information identifying at least one prohibited location, and to inhibit discharge of the firearm if the current location of the firearm is proximate a prohibited location identified in the memory; and (b) a signal bearing medium bearing the program.

28. The program product of claim 27, wherein the signal bearing medium includes at least one of a recordable medium and a transmission medium.

* * * * *